US012209807B2

(12) United States Patent
Matsumoto et al.

(10) Patent No.: US 12,209,807 B2
(45) Date of Patent: Jan. 28, 2025

(54) HEAT EXCHANGER AND AIR CONDITIONER

(71) Applicant: DAIKIN INDUSTRIES, LTD., Osaka (JP)

(72) Inventors: Yoshiyuki Matsumoto, Osaka (JP); Shun Yoshioka, Osaka (JP); Tooru Andou, Osaka (JP); Tomoki Hirokawa, Osaka (JP); Hideyuki Kusaka, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 255 days.

(21) Appl. No.: 17/307,116

(22) Filed: May 4, 2021

(65) Prior Publication Data

US 2021/0254897 A1 Aug. 19, 2021

Related U.S. Application Data

(63) Continuation of application No. PCT/JP2019/040228, filed on Oct. 11, 2019.

(30) Foreign Application Priority Data

Nov. 7, 2018 (JP) ..... 2018-209824

(51) Int. Cl.
*F28D 1/04* (2006.01)
*F28D 1/053* (2006.01)
(Continued)

(52) U.S. Cl.
CPC ..... *F28D 1/0435* (2013.01); *F28D 1/05358* (2013.01); *F28F 1/32* (2013.01); *F28F 9/0243* (2013.01); *F28D 2021/0068* (2013.01)

(58) Field of Classification Search
CPC .. F28F 1/128; F28F 9/002; F28F 13/06; F28F 1/24; F28D 1/05308; F28D 1/05358;
(Continued)

(56) References Cited

U.S. PATENT DOCUMENTS 3,517,733 A * 6/1970 Holmes ..... F28D 9/0068 165/166
7,228,885 B2 * 6/2007 Kolb ..... B60H 1/00328 60/599

(Continued)

FOREIGN PATENT DOCUMENTS

EP 2942594 A1 11/2015
JP H08-5198 A 1/1996

(Continued)

OTHER PUBLICATIONS

International Preliminary Report on Patentability issued in corresponding International Application No. PCT/JP2019/040228 dated May 20, 2021 (9 pages).

(Continued)

*Primary Examiner* — Frantz F Jules
*Assistant Examiner* — Jason N Thompson
(74) *Attorney, Agent, or Firm* — Osha Bergman Watanabe & Burton LLP

(57) ABSTRACT

A heat exchanger includes: rows of heat transfer tubes disposed next to one another in an air flow direction; and headers each connected to an end of each of the rows of heat transfer tubes. A center position of an upstream-most header disposed on a most upstream side in the air flow direction among the headers is displaced upstream in the air flow direction from a center position of an upstream-most row of the heat transfer tubes to which the upstream-most header is connected such that the upstream-most header is spaced (Continued)

apart from a row of the heat transfer tubes adjacent to the upstream-most row of the heat transfer tubes.

12 Claims, 6 Drawing Sheets

(51) Int. Cl.
*F28D 21/00* (2006.01)
*F28F 1/32* (2006.01)
*F28F 9/02* (2006.01)

(58) Field of Classification Search
CPC ..... F28D 1/0435; F28D 2001/0266; F28D 2001/0273
See application file for complete search history.

(56) References Cited

U.S. PATENT DOCUMENTS 7,392,837 B2 * 7/2008 Makino ..... F28F 9/18 165/140
9,528,772 B2 * 12/2016 Marold ..... F28D 9/0031
2005/0247439 A1 * 11/2005 Wada ..... F28D 1/0435 165/132
2009/0000771 A1 * 1/2009 Horn ..... F28D 1/0435 165/104.19
2011/0120177 A1 * 5/2011 Kirkwood ..... F28F 1/325 165/173
2014/0374072 A1 * 12/2014 Seewald ..... F28D 1/0435 165/150
2016/0003547 A1 * 1/2016 Okazawa ..... F28F 1/32 165/172
2016/0169586 A1 * 6/2016 Ito ..... F28F 1/022 29/890.03
2017/0211886 A1 7/2017 Morimura et al.
2019/0368817 A1 * 12/2019 Huang ..... F28F 9/0214
2020/0011605 A1 * 1/2020 Endo ..... F28D 1/05366
2020/0191501 A1 * 6/2020 Pelletier ..... F28F 1/14

FOREIGN PATENT DOCUMENTS

JP 2002318092 A * 10/2002 ..... F28D 1/0435
JP 2004-225961 A 8/2004
JP 2017-133820 A 8/2017
WO 2015/025702 A1 2/2015

OTHER PUBLICATIONS

Extended European Search Report issued in corresponding European Patent Application No. EP 19881134.1 dated Oct. 22, 2021 (6 pages).
International Search Report corresponding to International Patent Application No. PCT/JP2019/040228 dated Nov. 12, 2019 (1 page).

* cited by examiner

HEAT EXCHANGER AND AIR CONDITIONER

TECHNICAL FIELD

The present disclosure relates to a heat exchanger and an air conditioner.

BACKGROUND

A heat exchanger including heat transfer tubes (flat tubes) on an inlet side and an outlet side, and headers (header tanks) on the inlet side and the outlet side respectively connected to one end of the heat transfer tube on the inlet side and one end of the heat transfer tube on the outlet side has been known (see, e.g., Patent Document 1).

Patent Document 1 discloses a configuration in which the headers on the inlet side and the outlet side are arranged so as to be displaced in an extending direction of the heat transfer tubes so that the headers on the inlet side and the outlet side do not interfere with each other.

PATENT LITERATURE

Patent Document 1: Japanese Unexamined Patent Publication No. 2004-225961

SUMMARY

One or more embodiments are directed to a heat exchanger including a plurality of rows of heat transfer tubes (20) arranged next to one another in an air flow direction, and a plurality of headers (16) each connected to an end of an associated one of the plurality of rows of heat transfer tubes (20), wherein among the plurality of headers (16), an upstream-most header (16*a*) arranged on a most upstream side in the air flow direction is arranged such that a center position (O) of the upstream-most header (16*a*) is displaced upstream from a center position of an upstream-most heat transfer tube (20*a*) in the air flow direction in order that the upstream-most header (16*a*) is spaced apart from an adjacent heat transfer tube (20*b*) of a row adjacent to the upstream-most heat transfer tube (20*a*) to which the upstream-most header (16*a*) is connected, and/or among the plurality of headers (16), a downstream-most header (16*c*) arranged on a most downstream side in the air flow direction is arranged such that a center position (O) of the downstream-most header (16*c*) is displaced downstream from a center position of a downstream-most heat transfer tube (20*c*) in the air flow direction in order that the downstream-most header (16*c*) is spaced apart from an adjacent flat tube (20*b*) of a row adjacent to the downstream-most heat transfer tube (20*c*) to which the downstream-most header (16*c*) is connected.

DETAILED DESCRIPTION

First Embodiment

Figure 1:
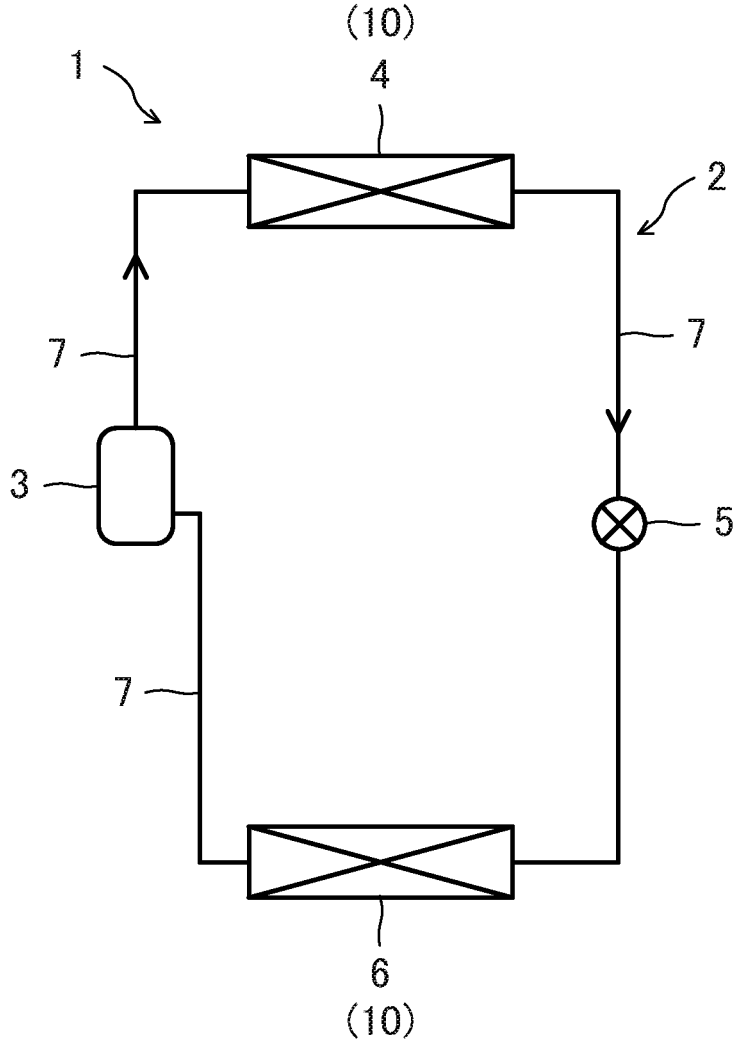
FIG. 1 is a schematic diagram illustrating a refrigerant circuit in an air conditioner according to a first embodiment.

A first embodiment will be now described. As shown in FIG. 1, a heat exchanger (10) of the present embodiment is provided in a refrigerant circuit (2) of an air conditioner (1) that performs a refrigeration cycle, and causes a refrigerant flowing through the refrigerant circuit (2) to exchange heat with air.

The refrigerant circuit (2) is comprised of a compressor (3), a condenser (4), an expansion valve (5), and an evaporator (6), which are sequentially connected by refrigerant pipes (7).

If the air conditioner (1) includes an indoor unit and an outdoor unit, the heat exchanger (10) of the present embodiment may serve as the evaporator (6) provided in the indoor unit or as the condenser (4) provided in the outdoor unit. The refrigerant caused by the heat exchanger (10) to exchange heat with air may be a so-called chlorofluorocarbon refrigerant such as HFC-32, or a so-called natural refrigerant such as carbon dioxide.

—Configuration of Heat Exchanger—

Figure 2:
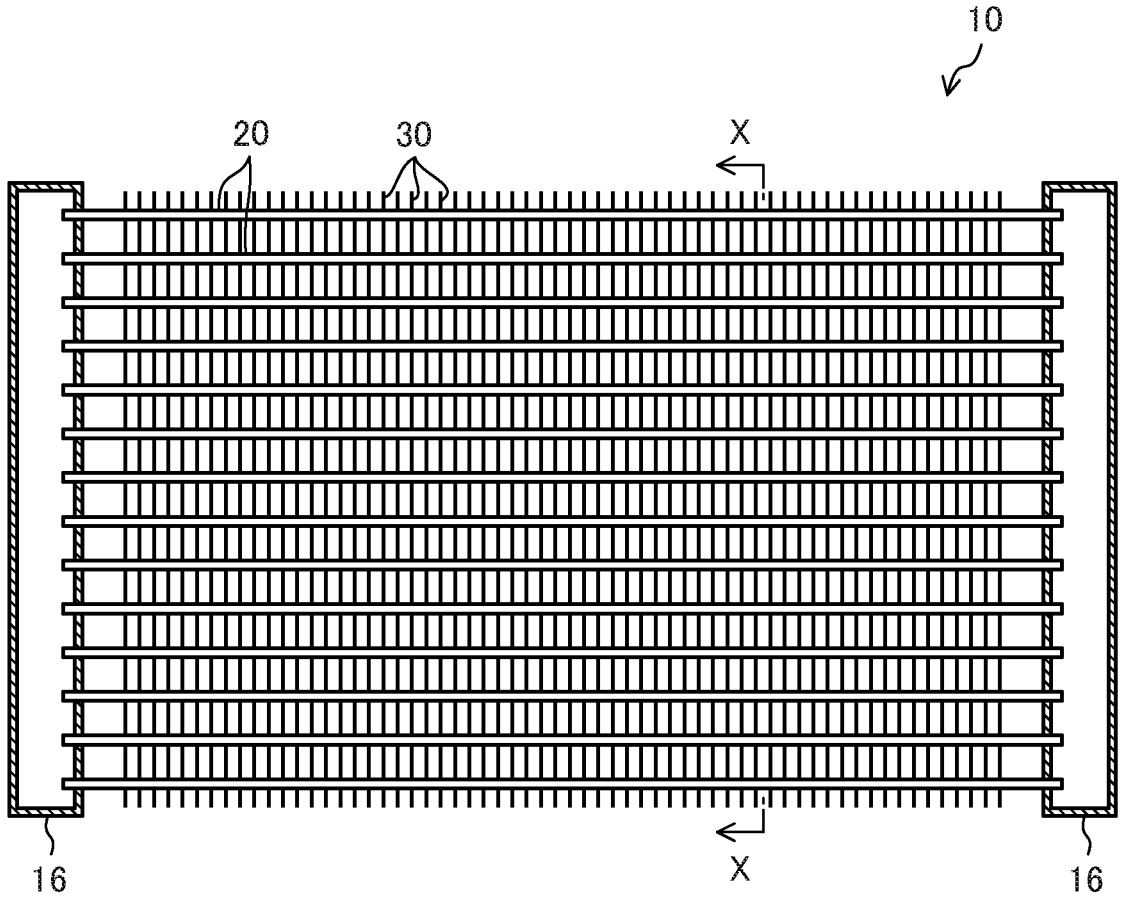
FIG. 2 is a front sectional view illustrating a configuration of a heat exchanger.
Figure 3:
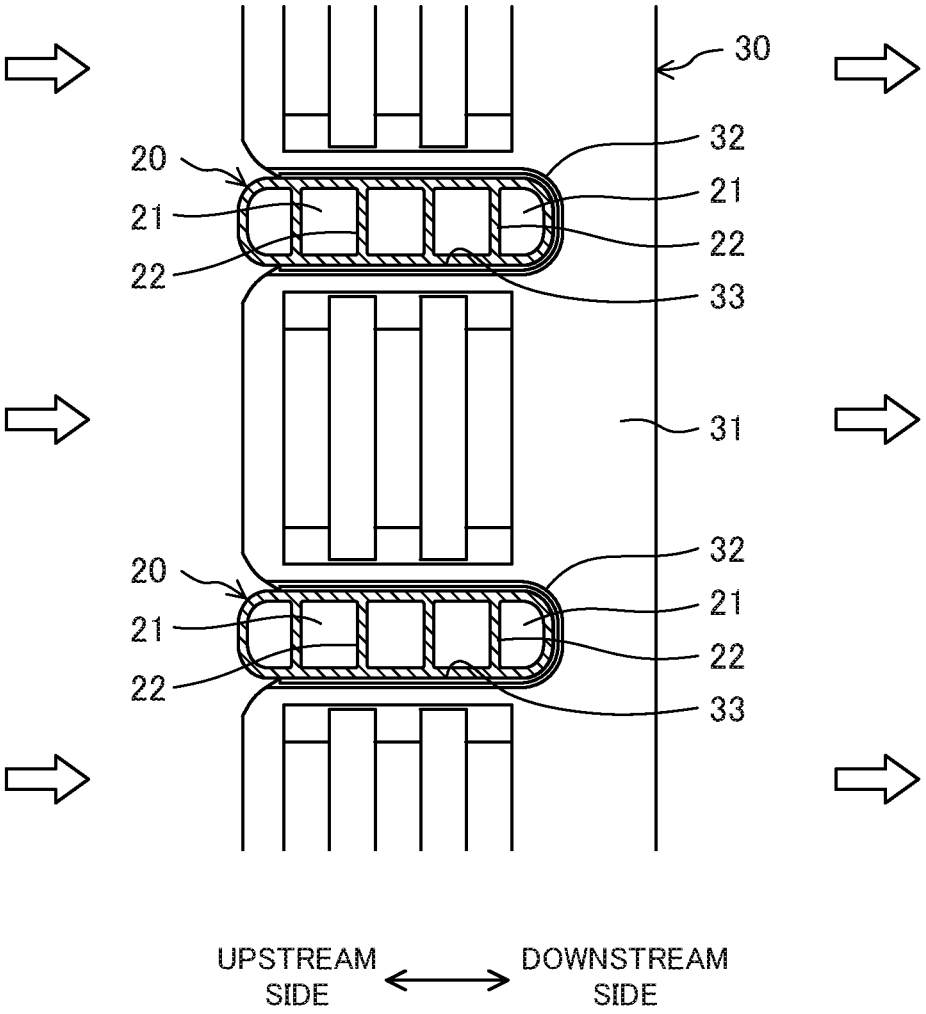
FIG. 3 is a cross-section viewed in the direction of arrows X-X of FIG. 2.

As shown in FIGS. 2 and 3, the heat exchanger (10) of the present embodiment includes a pair of headers (16), a large number of flat tubes (20) (heat transfer tubes), and a large number of fins (30). The headers (16), the flat tubes (20), and the fins (30) are all members made of an aluminum alloy.

Figure 4:
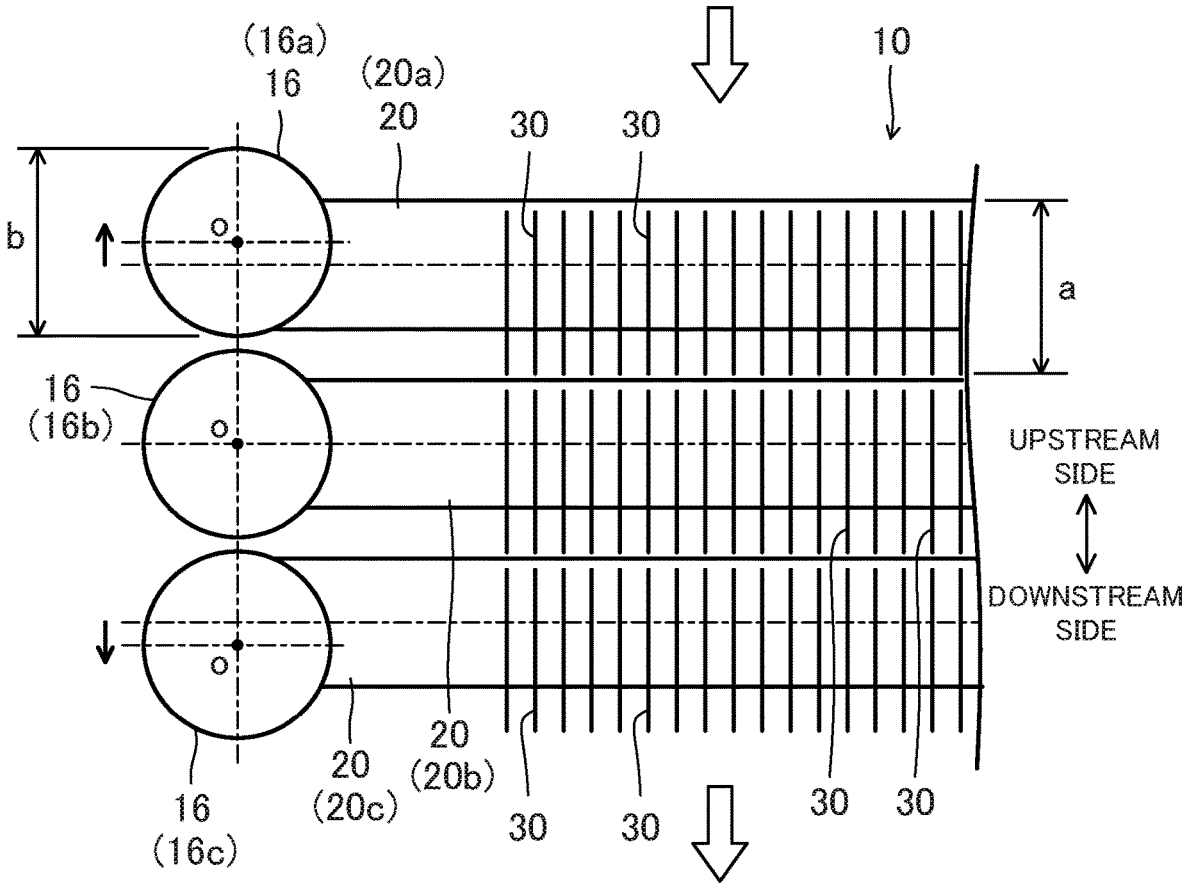
FIG. 4 is a plan view illustrating the configuration of the heat exchanger.

As shown in FIG. 4, the flat tubes (20) are arranged in three rows in an air flow direction. The headers (16) are provided for each row of the flat tubes (20) independently of one another. The headers (16) are joined to both end portions of each row of the flat tubes (20). The number of the flat tubes (20) is merely an example, and there may be two, four, or more rows of the flat tubes (20).

<Header>

The header (16) is formed in an elongated hollow cylindrical shape with both ends closed. In FIG. 2, a pair of headers (16) are arranged upright at both ends of the heat exchanger (10). The position at which the headers (16) are joined to the flat tubes (20) will be described later.

<Flat Tube>

As shown in FIG. 3, the flat tube (20) is a flat-shaped tube whose width is greater than its thickness. The flat tube (20) has a rectangular shape with rounded corners, in a cross section taken in a direction orthogonal to an extending direction of the flat tube (20). The plurality of flat tubes (20) are arranged such that their side surfaces extending along the width direction face each other.

Further, the plurality of flat tubes (20) are arranged one above another in a vertical direction at regular intervals from one another. Both end portions of each flat tube (20) are inserted into the respective headers (16). The headers (16) are fixed to the flat tubes (20) by brazing, which is joining with a brazing material.

A plurality of flow paths (21) partitioned by partition walls (22) are formed in each of the flat tubes (20). In the flat tube (20) of the present embodiment, four partition walls (22) are provided to form five flow paths (21). However, the number of partition walls (22) and flow paths (21) presented herein is merely an example.

In the flat tube (20), the five flow paths (21) extend parallel with one another along the extending direction of the flat tube (20). Each of the flow paths (21) opens at both end surfaces of the flat tube (20). In the flat tube (20), the five flow paths (21) are arranged next to one another in the width direction of the flat tube (20).

<Fin>

The fin (30) includes a fin body (31) formed in a substantially rectangular plate shape, and a collar portion (32) formed integrally with the fin body (31). A plurality of openings (33) for inserting the flat tubes (20) are formed in the fin body (31). The plurality of openings (33) are arranged in a direction along a long side of the fin body (31).

The opening (33) is formed in a shape of a notch that opens at one long side of the fin body (31) and extends in a short side direction of the fin body (31). The long side of the fin body (31) extends in the vertical direction in FIG. 3, and the short side direction of the fin body (31) is a horizontal direction in FIG. 3.

The collar portion (32) is formed continuously with an edge of the opening (33) in the fin body (31). The collar portion (32) protrudes from the edge of the opening (33) in a direction intersecting with the fin body (31).

As shown in FIG. 2, the plurality of fins (30) are arranged such that the respective fin bodies (31) face each other. The plurality of fins (30) are arranged such that the corresponding openings (33) of the respective fins (30) are aligned. The fin bodies (31) of the adjacent fins (30) are kept at a regular interval due to protruding ends of the collar portions (32) abutting against the fin bodies (31) of the adjacent fins (30).

An inner surface of the collar portion (32) of the fin (30) is in contact with an outer surface of the flat tube (20) expanded by a tube expander. The collar portion (32) of the fin (30) is fixed to the flat tube (20) by brazing with the brazing material. That is, the fin (30) is fixed to the flat tube (20) by the tube expander that expands the flat tube (20) and the joining (i.e., brazing) with the brazing material which is a joining material.

—Arrangement of Headers—

As shown in FIG. 4, the three rows of flat tubes (20) have the same length. The headers (16) of the three rows are arranged such that center positions (0) of the headers (16) are aligned in the air flow direction.

Here, for example, in a case in which an outer diameter b of the header (16) is larger than a row width a including the fin (30) and the flat tube (20), coinciding the center position (O) of the header (16) and a center position of the flat tube (20) with each other results in interference of the header (16) with the header (16) of the adjacent row. To avoid this, it is necessary to keep the flat tubes (20) apart from each other and ensure a large gap therebetween. However, this structure is not preferable since it increases the outer diameter of the entire heat exchanger (10).

Therefore, in the present embodiment, the arrangement of the headers (16) is devised to avoid the interference of the header (16) with the header (16) of the adjacent row.

Specifically, among the headers (16) of the three rows, an upstream-most header (16*a*) arranged on the most upstream side in the air flow direction is arranged such that the center position (O) of the upstream-most header (16*a*) is displaced upstream from the center position of an upstream-most flat tube (20*a*, or an upstream-most row of flat tubes) in the air flow direction in order that the upstream-most header (16*a*) is spaced apart from an adjacent flat tube (20*b*) of the row adjacent to the upstream-most flat tube (20*a*) to which the upstream-most header (16*a*) is connected. In this configuration, an upstream end of the upstream-most header (16*a*) is positioned upstream from an upstream end of the fin (30).

Among the headers (16) of the three rows, a downstream-most header (16*c*) arranged on the most downstream side in the air flow direction is arranged such that the center position (O) of the downstream-most header (16*c*) is displaced downstream from the center position of a downstream-most flat tube (20*c*, or a downstream-most row of flat tubes) in the air flow direction in order that the downstream-most header (16*c*) is spaced apart from the adjacent flat tube (20*b*) of the row adjacent to the downstream-most flat tube (20*c*) to which the downstream-most header (16*c*) is connected. In this configuration, a downstream end of the downstream-most header (16*c*) is positioned downstream from a downstream end of the fin (30).

Note that among the headers (16) of the three rows, the center position (O) of the adjacent header (16*b*) arranged at the center substantially coincides with the center position of the adjacent flat tube (20*b*).

Thus, the upstream-most header (16*a*) and the downstream-most header (16*c*) may be arranged so as not to interfere with the adjacent header (16*b*) of the adjacent row. Since it is not necessary to keep the plurality of rows of flat tubes (20) apart from one another to make a larger gap therebetween, the entire heat exchanger (10) may be downsized.

Advantages of First Embodiment

The heat exchanger (10) of the present embodiment includes a plurality of rows of flat tubes (20) (heat transfer tubes) arranged next to one another in the air flow direction, and a plurality of headers (16) each connected to an end of an associated one of the plurality of rows of flat tubes (20). Among the plurality of headers (16), an upstream-most header (16*a*) arranged on a most upstream side in the air flow direction is arranged such that a center position (O) of the upstream-most header (16*a*) is displaced upstream from a center position of an upstream-most flat tube (20*a*) in the air flow direction in order that the upstream-most header (16*a*) is spaced apart from an adjacent flat tube (20*b*) of a row adjacent to the upstream-most flat tube (20*a*) to which the upstream-most header (16*a*) is connected, and/or among the plurality of headers (16), a downstream-most header (16*c*) arranged on a most downstream side in the air flow direction is arranged such that a center position (O) of the downstream-most header (16*c*) is displaced downstream from a center position of a downstream-most flat tube (20*c*) in the air flow direction in order that the downstream-most header (16*c*) is spaced apart from an adjacent flat tube (20*b*) of a row adjacent to the downstream-most flat tube (20*c*) to which the downstream-most header (16*c*) is connected.

In the present embodiment, the center position (O) of the upstream-most header (16*a*) is arranged to be displaced upstream from the center position of the upstream-most flat tube (20*a*), and/or the center position (O) of the downstream-most header (16*c*) is arranged to be displaced downstream from the center position of the downstream-most flat tube (20*c*).

Thus, the upstream-most header (16*a*) and/or the downstream-most header (16*c*) may be arranged so as not to interfere with the adjacent header (16*b*) of the adjacent row. Since it is not necessary to keep the plurality of rows of flat tubes (20) apart from one another to make a larger gap therebetween, the entire heat exchanger (10) may be downsized.

Further, the heat exchanger (10) of the present embodiment includes a fin (30) arranged so as to intersect with the flat tubes (20). In a case in which the center position (O) of the upstream-most header (16*a*) is arranged so as to be displaced upstream from the center position of the upstream-most flat tube (20*a*) in the air flow direction, an upstream end of the upstream-most header (16*a*) is positioned upstream from an upstream end of the fin (30), and in a case in which the center position (O) of the downstream-most header (16*c*) is arranged so as to be displaced downstream from the center position of the downstream-most flat tube (20*c*) in the air flow direction, a downstream end of the downstream-most header (16*c*) is positioned downstream from a downstream end of the fin (30).

In the present embodiment, in the case in which the center position (O) of the upstream-most header (16*a*) is displaced upstream, the upstream end of the upstream-most header (16*a*) is positioned upstream from the upstream end of the fin (30). In the case in which the center position (O) of the downstream-most header (16*c*) is displaced downstream, the downstream end of the downstream-most header (16*c*) is positioned downstream from the upstream end of the fin (30).

Thus, positioning the end of the upstream-most header (16*a*) or the downstream-most header (16*c*) upstream or downstream from the end of the fin (30) makes it possible to prevent the upstream-most header (16*a*) or the downstream-most header (16*c*) from interfering with a member of the adjacent row.

The air conditioner (1) of the present embodiment includes the heat exchanger (10) described above.

In the present embodiment, the above-described heat exchanger (10) is applied to an air conditioner.

Second Embodiment

A second embodiment will be now described. Differences between the heat exchanger (10) of the present embodiment and the heat exchanger (10) of the first embodiment will be described herein.

Figure 5:
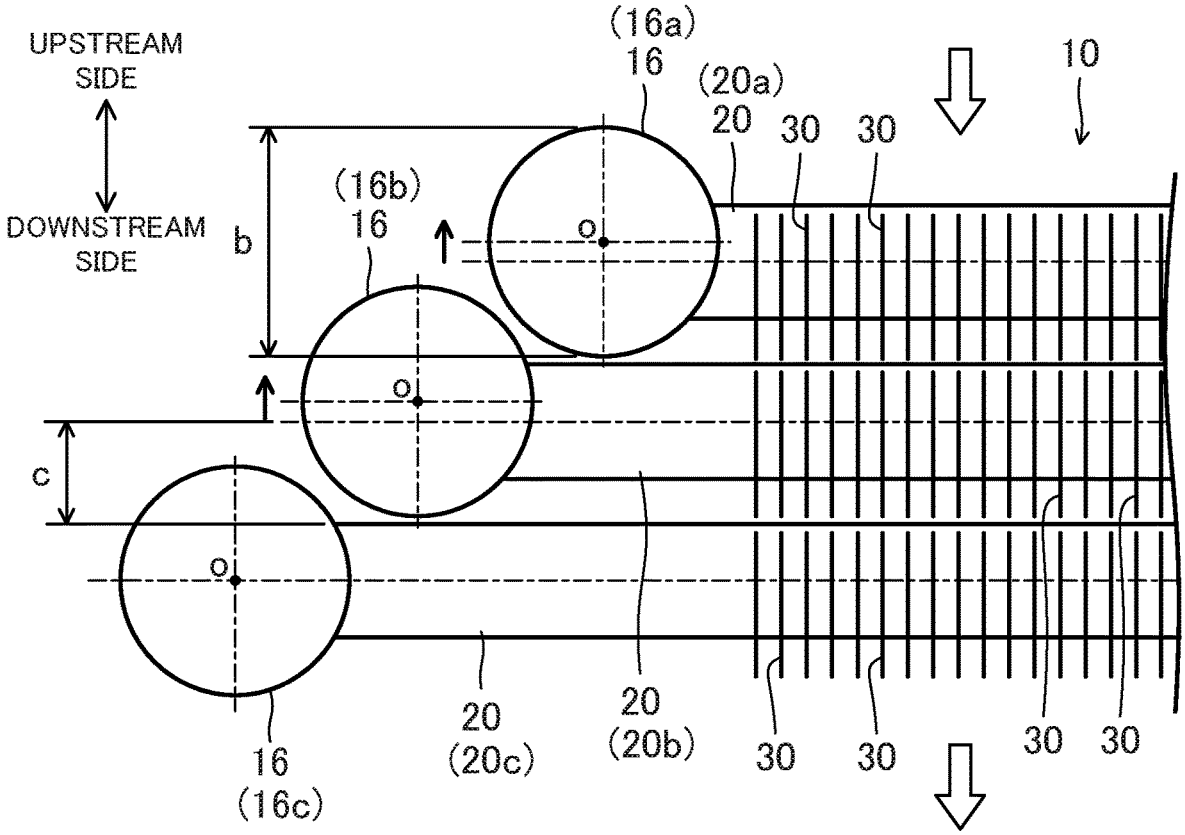
FIG. 5 is a plan view illustrating a configuration of a heat exchanger according to a second embodiment.
Figure 6:
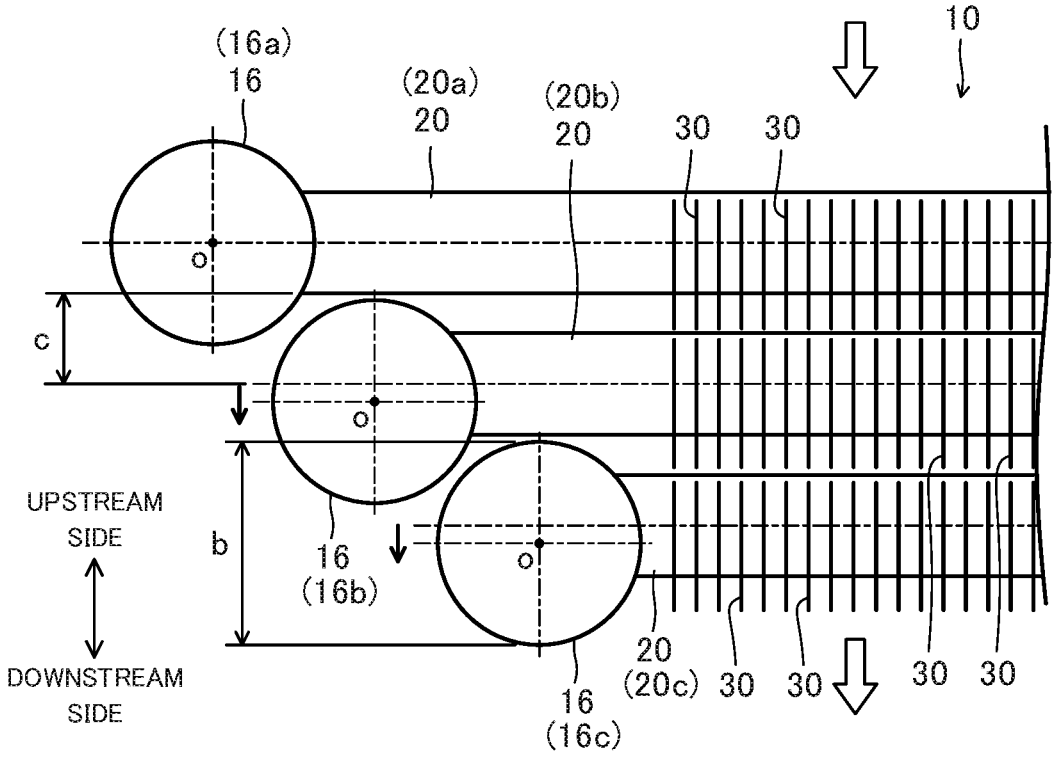
FIG. 6 is a plan view illustrating a configuration of a heat exchanger according to another form of the second embodiment.

As shown in FIGS. 5 and 6, the headers (16) of three rows are arranged so as to be displaced in the extending direction of the flat tubes (20). Here, for example, in a case in which the outer diameter b of the header (16) is larger than twice (2*c*) a distance c between the center position of the flat tube (20) and the flat tube (20) of the adjacent row, coinciding the center position (O) of the header (16) and the center position of the flat tube (20) with each other results in interference of the header (16) with the header (16) of the adjacent row. To avoid this, it is necessary to keep the flat tubes (20) apart from each other and ensure a large gap therebetween. However, this structure is not preferable since it increases the outer diameter of the entire heat exchanger (10).

Therefore, in the present embodiment, the arrangement of the headers (16) is devised to avoid the interference of the header (16) with the flat tube (20) of the adjacent row.

Specifically, as shown in FIG. 5, among the three rows of the flat tubes (20), the upstream-most flat tube (20*a*) arranged on the most upstream side in the air flow direction has a shorter length than the adjacent flat tube (20*b*) of the row adjacent to the upstream-most flat tube (20*a*), and the adjacent flat tube (20*b*) has a shorter length than the downstream-most flat tube (20*c*) arranged on the most downstream side in the air flow direction. Alternatively, as shown in FIG. 6, among the three rows of the flat tubes (20), the downstream-most flat tube (20*c*) arranged on the most downstream side in the air flow direction has a shorter length than the adjacent flat tube (20*b*) of the row adjacent to the downstream-most flat tube (20*c*), and the adjacent flat tube (20*b*) has a shorter length than the upstream-most flat tube (20*a*) arranged on the most upstream side in the air flow direction.

Further, as shown in FIG. 5, among the headers (16) of the three rows, the upstream-most header (16*a*) arranged on the most upstream side in the air flow direction is arranged such that the center position (O) of the upstream-most header (16*a*) is displaced upstream from the center position of the upstream-most heat transfer tube (20*a*) in the air flow direction in order that the upstream-most header (16*a*) is spaced apart from the adjacent flat tube (20*b*) of the row adjacent to the upstream-most flat tube (20*a*) to which the upstream-most header (16*a*) is connected. In this configuration, an upstream end of the upstream-most header (16*a*) is positioned upstream from an upstream end of the fin (30). Alternatively, as shown in FIG. 6, among the headers (16) of the three rows, the downstream-most header (16*c*) arranged on the most downstream side in the air flow direction is arranged such that the center position (O) of the downstream-most header (16*c*) is displaced downstream from the center position of the downstream-most heat transfer tube (20*c*) in the air flow direction in order that the downstream-most header (16*c*) is spaced apart from the adjacent flat tube (20*b*) of the row adjacent to the downstream-most flat tube (20*c*) to which the downstream-most header (16*c*) is connected. In this configuration, a downstream end of the downstream-most header (16*c*) is positioned downstream from a downstream end of the fin (30).

In the embodiment shown in FIG. 5, among the headers (16) of the three rows, the adjacent header (16*b*) arranged at the center is arranged to be displaced in the same direction as the upstream-most header (16*a*) is displaced, that is, the center position (O) of the adjacent header (16*b*) is arranged so as to be displaced upstream from the center position of the adjacent flat tube (20*b*). Alternatively, in the embodiment shown in FIG. 6, among the headers (16) of the three rows, the adjacent header (16*b*) arranged at the center is arranged to be displaced in the same direction as the downstream-most header (16*c*) is displaced, that is, the center position (O) of the adjacent header (16*b*) is arranged so as to be displaced downstream from the center position of the adjacent flat tube (20*b*).

Note that, in FIG. 5, the center position (O) of the downstream-most header (16*c*) arranged at the most downstream side in the air flow direction among the headers (16) of three rows substantially coincides with the center position of the downstream-most flat tube (20*c*) to which the downstream-most header (16*c*) is connected. Alternatively, in FIG. 6, the center position (O) of the upstream-most header (16*a*) arranged at the most upstream side in the air flow direction among the headers (16) of three rows substantially coincides with the center position of the upstream-most flat tube (20*a*) to which the upstream-most header (16*a*) is connected.

Thus, in the embodiments shown in FIGS. 5 and 6, the upstream-most header (16*a*), the adjacent header (16*b*), and the downstream-most header (16*c*) may be arranged so as not to interfere with the flat tube (20) of the adjacent row. Since it is not necessary to keep the plurality of rows of flat tubes (20) apart from one another to make a larger gap therebetween, the entire heat exchanger (10) may be downsized.

Advantages of Second Embodiment

The heat exchanger (10) of the present embodiment includes the plurality of headers (16) arranged so as to be displaced in the extending direction of the flat tubes (20).

In the present embodiment, displacement of the plurality of headers (16) in the extending direction of the flat tubes (20) makes it possible to prevent the headers (16) from interfering with a member of the adjacent row.

In the heat exchanger (10) of the present embodiment, the flat tubes (20) are provided in three or more rows. The center position (O) of the adjacent header (16*b*) connected to the flat tube (20) of the adjacent row is arranged so as to be displaced with respect to the center position of the flat tube (20) of the same adjacent row in the same direction as the direction in which the upstream-most header (16*a*) or the downstream-most header (16*c*) is displaced.

In this embodiment, in the case in which three or more rows of flat tubes (20) are provided, displacement of the center position (O) of the adjacent header (16*b*) of the adjacent row in the same direction as the displacement direction of the upstream-most header (16*a*) or the downstream-most header (16*c*) makes it possible to prevent the headers (16) from interfering with a member of the adjacent row.

In the heat exchanger (10) of the present embodiment, the center positions (0) of the plurality of headers (16) are arranged so as to be displaced with respect to the center positions of the flat tubes (20) to which the plurality of headers (16) are connected, in the direction in which the upstream-most header (16*a*) or the downstream-most header (16*c*) is displaced with respect to the center position of the upstream-most heat transfer tube (20*a*) or the downstream-most heat transfer tube (20*c*).

In the present embodiment, displacement of the center positions (0) of the plurality of headers (16) in the direction in which the upstream-most header (16*a*) or the downstream-most header (16*c*) is displaced makes it possible to prevent the headers (16) from interfering with a member of the adjacent row.

In the present embodiment, the upstream-most header (16*a*) and the adjacent header (16*b*) are arranged so as to be displaced toward the upstream side, and the center position (O) of the downstream-most header (16*c*) and the center position of the downstream-most flat tube (20*c*) substantially coincide with each other. However, the present disclosure is not limited thereto. For example, the center position (O) of the downstream-most header (16*c*) may be arranged so as to be displaced in the same direction as the displacement direction of the upstream-most header (16*a*), that is, toward the upstream side in the air flow direction.

As can be seen from the foregoing description, the present disclosure is useful for a heat exchanger and an air conditioner.

Although the disclosure has been described with respect to only a limited number of embodiments, those skilled in the art, having benefit of this disclosure, will appreciate that various other embodiments may be devised without departing from the scope of the present disclosure.

REFERENCE SIGNS LIST

1 Air Conditioner
10 Heat Exchanger
16 Header
16*a* Upstream-most Header
16*b* Adjacent Header
16*c* Downstream-most Header
Flat Tube (Heat Transfer Tube)
20*a* Upstream-most Flat Tube (Upstream-most Heat Transfer Tube)
20*b* Adjacent Flat Tube (Adjacent Heat Transfer Tube)
20*c* Downstream-most Flat Tube (Downstream-most Heat Transfer Tube)
30 Fin
O Center Position

What is claimed is:

1. A heat exchanger comprising:
heat transfer tubes disposed in at least three rows and spaced apart from one another in an air flow direction of the heat exchanger; and
headers, each connected to an end of a corresponding one of the rows of heat transfer tubes, wherein
each of the rows of heat transfer tubes is connected to only one of the headers at the end of the corresponding one of the rows of heat transfer tubes,
the rows of heat transfer tubes do not overlap in a direction of the headers extending,
an outer diameter of each of the headers is larger than a row width of one of the rows of the heat transfer tubes connected to the each of the headers,
a center position of an upstream-most header disposed on a most upstream side in the air flow direction among the headers is displaced upstream in the air flow direction from a center position of an upstream-most row of the heat transfer tubes to which the upstream-most header is connected at a position where the upstream-most row of the heat transfer tubes is attached to the upstream-most header such that the upstream-most header is spaced apart from a row of the heat transfer tubes adjacent to the upstream-most row of the heat transfer tubes, and
a center position of an adjacent header connected to the row of the heat transfer tubes adjacent to the upstream-most row is displaced upstream in the air flow direction with respect to a center position of the row of the heat transfer tubes adjacent to the upstream-most row.

2. The heat exchanger according to claim 1, wherein the headers are displaced in an extending direction of the heat transfer tubes.

3. The heat exchanger according to claim 1, wherein
center positions of the headers are displaced upstream in the air flow direction with respect to respective center positions of the rows of the heat transfer tubes to which the headers are connected.

4. The heat exchanger according to claim 1, further comprising:
a fin that intersects with the heat transfer tubes, wherein
an upstream end of the upstream-most header is positioned upstream from an upstream end of the fin.

5. An air conditioner comprising the heat exchanger according to claim 1.

6. The heat exchanger according to claim 1, wherein an amount of displacement of the center position of the upstream-most header in the air flow direction from the center position of the upstream-most row is greater than a distance in the air flow direction between a center position of one of the headers different from the upstream-most header and a center position of a row of the heat transfer tubes attached to the one of the headers.

7. A heat exchanger comprising:
heat transfer tubes disposed in at least three rows and spaced apart from one another in an air flow direction of the heat exchanger; and
headers, each connected to an end of a corresponding one of the rows of heat transfer tubes, wherein
each of the rows of heat transfer tubes is connected to only one of the headers at the end of the corresponding one of the rows of heat transfer tubes, the rows of heat transfer tubes do not overlap in a direction of the headers extending, an outer diameter of each of the headers is larger than a row width of one of the rows of the heat transfer tubes connected to the each of the headers, a center position of a downstream-most header disposed on a most downstream side in the air flow direction among the headers is displaced downstream in the air flow direction from a center position of a downstream-most row of the heat transfer tubes to which the downstream-most header is connected at a position where the downstream-most row of the heat transfer tubes is attached to the downstream-most header such that the downstream-most header is spaced apart from a row of the heat transfer tubes adjacent to the downstream-most row of the heat transfer tubes, and a center position of an adjacent header connected to the row of the heat transfer tubes adjacent to the downstream-most row is displaced downstream in the air flow direction with respect to a center position of the row of the heat transfer tubes adjacent to the downstream-most row.

8. The heat exchanger according to claim 7, wherein the headers are displaced in an extending direction of the heat transfer tubes.

9. The heat exchanger according to claim 7, wherein center positions of the headers are displaced downstream in the air flow direction with respect to respective center positions of the rows of the heat transfer tubes to which the headers are connected.

10. The heat exchanger according to claim 7, further comprising:

a fin that intersects with the heat transfer tubes, wherein a downstream end of the downstream-most header is positioned downstream from a downstream end of the fin.

11. An air conditioner comprising the heat exchanger according to claim 7.

12. The heat exchanger according to claim 7, wherein an amount of displacement of the center position of the downstream-most header in the air flow direction from the center position of the downstream-most row is greater than a distance in the air flow direction between a center position of one of the headers different from the downstream-most header and a center position of a row of the heat transfer tubes attached to the one of the headers.

* * * * *